US011253789B2

(12) United States Patent
Johnson

(10) Patent No.: US 11,253,789 B2
(45) Date of Patent: Feb. 22, 2022

(54) LIGHT PROJECTION APPARATUS AND METHOD FOR TWINKLING OR VARYING DISPLAY OF BRIGHTNESS

(71) Applicant: BTL DIFFUSION SARL, Méré (FR)

(72) Inventor: Jeffery Wayne Johnson, Lawndale, CA (US)

(73) Assignee: BTL DIFFUSION SARL, Méré (FR)

( * ) Notice: Subject to any disclaimer, the term of this patent is extended or adjusted under 35 U.S.C. 154(b) by 0 days.

(21) Appl. No.: 16/752,579

(22) Filed: Jan. 24, 2020

(65) Prior Publication Data

US 2020/0238184 A1 Jul. 30, 2020

Related U.S. Application Data

(60) Provisional application No. 62/796,535, filed on Jan. 24, 2019.

(51) Int. Cl.
*A63H 3/00* (2006.01)
*A63H 3/28* (2006.01)

(52) U.S. Cl.
CPC ..... *A63H 3/006* (2013.01); *A63H 3/28* (2013.01)

(58) Field of Classification Search
CPC ..... A63H 3/02; A63H 3/006; A63H 3/28
USPC ..... 446/72, 219, 368, 369, 484, 485
See application file for complete search history.

(56) References Cited

U.S. PATENT DOCUMENTS 4,497,582 A * 2/1985 Lipman ..... G04B 23/02 368/15
4,579,534 A * 4/1986 Lipman ..... G09B 27/04 434/286
4,726,773 A * 2/1988 Lazar ..... G09B 27/04 40/583
4,858,079 A * 8/1989 Ohashi ..... A63H 5/00 362/35
4,955,714 A * 9/1990 Stotler ..... G09B 27/00 353/122
5,324,224 A * 6/1994 Anderson ..... A63H 33/26 362/184
6,652,348 B2 * 11/2003 Yen ..... B05B 17/08 239/17
6,894,434 B1 * 5/2005 Kosoff ..... A61M 21/02 315/134

(Continued)

*Primary Examiner* — Joseph B Baldori
(74) *Attorney, Agent, or Firm* — Pearl Cohen Zedek Latzer Baratz LLP

(57) ABSTRACT

A light projection apparatus in the shape of a toy animal includes components that promote a twinkling effect on a display of light through an outer shell. The outer shell includes apertures that together form a pattern in the appearance of a constellation on a surface when light is projected outwardly from inside the apparatus. Light-emitting members are spread apart internally on a surface within the apparatus, and each member has a perforated cover positioned above it to partially block light emitted therefrom. Each cover has either a different pattern and/or a different orientation relative to the light-emitting member it covers, and each member is also configured to slowly brighten and dim, the combination of which creates the twinkling effect when light is projected out through the apertures. Each member's brightening and dimming function may be at predetermined intervals independent of other members, and may also be of a different color, to increase the effect.

8 Claims, 4 Drawing Sheets

(56) References Cited

U.S. PATENT DOCUMENTS

| | | | | |
|---|---|---|---|---|
| 7,473,002 | B1 * | 1/2009 | Chen | F21S 10/00 362/283 |
| 7,520,633 | B2 * | 4/2009 | Hornsby | F21V 33/0012 362/231 |
| 7,832,917 | B2 * | 11/2010 | Chien | F21V 9/12 362/641 |
| 7,871,192 | B2 * | 1/2011 | Chien | G01S 3/7864 362/641 |
| 7,909,468 | B2 * | 3/2011 | Lloyd | G03B 21/06 353/50 |
| 9,114,326 | B2 * | 8/2015 | Johnson | A63H 3/003 |
| 9,122,136 | B2 * | 9/2015 | Tang | A63H 33/22 |
| 9,157,589 | B2 * | 10/2015 | Chien | F21S 8/035 |
| 9,656,181 | B2 * | 5/2017 | Hocherman | A63H 33/22 |
| 9,664,373 | B2 * | 5/2017 | Zhang | F21V 23/0407 |
| 9,946,141 | B2 * | 4/2018 | Sum | G03B 21/001 |
| 10,335,697 | B2 * | 7/2019 | Villano | A63H 33/22 |
| 2009/0122548 | A1 * | 5/2009 | Dalsgaard | F21V 17/164 362/282 |
| 2012/0188451 | A1 * | 7/2012 | Schmidt | A63H 33/006 348/553 |
| 2013/0040532 | A1 * | 2/2013 | Khubani | A63H 3/02 446/369 |
| 2013/0280985 | A1 * | 10/2013 | Klein | A63H 3/003 446/297 |
| 2014/0268882 | A1 * | 9/2014 | Hoang | F21V 21/32 362/642 |
| 2015/0276178 | A1 * | 10/2015 | Chien | F21V 23/0442 362/95 |
| 2016/0209013 | A1 * | 7/2016 | Chien | F21S 10/002 |
| 2020/0238184 | A1 * | 7/2020 | Johnson | A63H 3/006 |

* cited by examiner

LIGHT PROJECTION APPARATUS AND METHOD FOR TWINKLING OR VARYING DISPLAY OF BRIGHTNESS

CROSS-REFERENCE TO RELATED PATENT APPLICATION(S)

This patent application claims priority to U.S. provisional application 62/796,535, filed on Jan. 24, 2019, the contents of which are incorporated in their entirety herein. In accordance with 37 C.F.R. § 1.76, a claim of priority is included in an Application Data Sheet filed concurrently herewith. This patent application also incorporates by reference the disclosure of U.S. patent application publication 2020/0238184 A1 including the figures thereof, which is the publication of this patent application (the "Application Publication").

FIELD OF THE INVENTION

The present invention relates to light projection in toys. Specifically, the present invention relates to a system and method of projecting a twinkling and varying display of lights in a toy.

BACKGROUND OF THE INVENTION

In the field of toys that include a display of light, there are many approaches to illumination. Some toys merely activate a projection of light when an illumination function is activated, while others project a particular display as a theme. Many themes are possible, and many prior art examples of devices exist where such an illumination is projected out from inside a toy, such as a device having illumination components mounted inside a shell.

One such theme relates to stellar or celestial bodies, intended for example to mimic a constellation of stars when the illumination function is activated, to provide the impression of a star-filled night sky. The shell of the toy may have cutouts that form a depiction of the constellation when light emitted from inside the device is projected outward. Toys encompassing such a theme are often provided as nightlights as children fall asleep.

One problem with such displays of a constellation of celestial bodies in the field of toys is that these displays are static, in that they only display one pattern that does not change. The only mechanism for altering the illumination is to switch the lighting devices on and off, meaning that the appearance of the constellation itself does not change.

BRIEF SUMMARY OF THE INVENTION

The present invention is an approach to projecting light from inside a toy to an area outside of the toy, in which a varying configuration of such light is displayed. In such an approach, a plurality of light blockers are positioned over light-emitting diodes (LEDs) whose luminous intensities vary over time, either by switching on or off, or by brightening or dimming the lights, such as by varying voltages applied to such LEDs. In one embodiment, the toy is shaped like an animal, having an outer shell through which a pattern in the form of a constellation of celestial bodies is displayed outside of the toy. The approach of the present invention provides the appearance of a twinkling constellation, thereby mimicking a nighttime sky where stars change in brightness.

It is therefore one objective of the present invention to provide a toy that projects a varying configuration on a surface outside the toy from light projected from inside the toy. It is another objective of the present invention to provide an apparatus that provides the impression of a star-filled night sky inside a room where the apparatus is placed. It is a further objective of the present invention to provide such a toy or apparatus in the shape of an animal.

It is still another objective of the present invention to provide an approach for varying the configuration displayed by such a toy or apparatus so that a twinkling effect appears when illumination occurs. It is yet another objective of the present invention to provide a nightlight for aiding in children's sleep that includes such a twinkling effect.

Other objects, embodiments, features, and advantages of the present invention will become apparent from the following description of the embodiments, taken together with any accompanying drawings, which illustrate, by way of example, the principles of the invention.

BRIEF DESCRIPTION OF THE SEVERAL VIEWS OF THE DRAWINGS

The accompanying drawings, which are incorporated in and constitute a part of this specification, illustrate several embodiments of the invention and together with the description, serve to explain the principles of the invention.

DETAILED DESCRIPTION OF THE INVENTION

In the following description of the present invention, exemplary embodiments illustrate the principles of the present invention and how it is practiced. Other embodiments will be utilized to practice the present invention and structural and functional changes will be made thereto without departing from the scope of the present invention.

Figure 1:
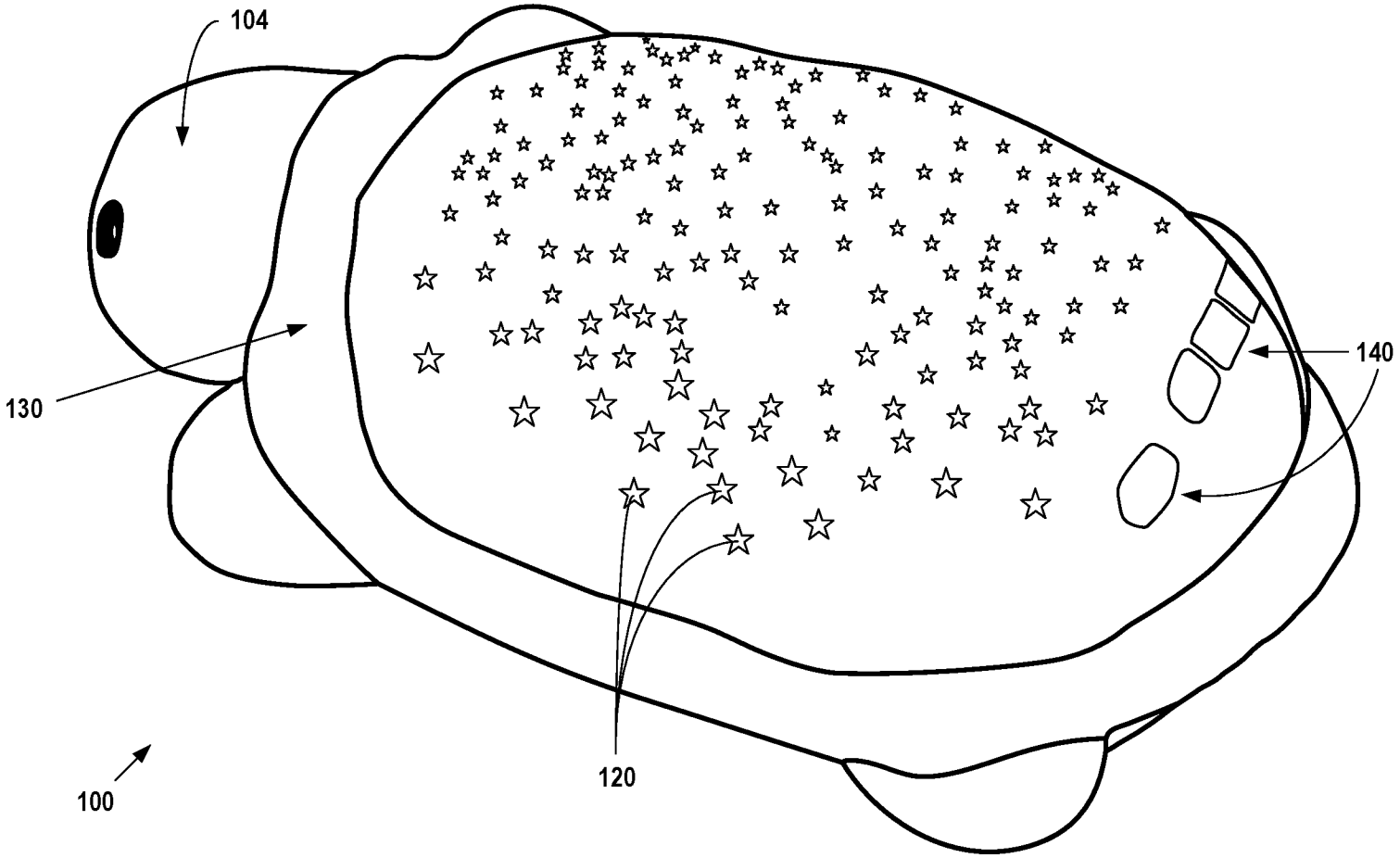
FIG. 1 is a rear elevated perspective view of an apparatus and child's toy according to one aspect of the present invention.

FIG. 1 of the Application Publication and FIG. 1 hereof each is a rear elevated perspective view of an apparatus 100 according to the present invention. As shown in others of FIGS. 1-8 of the Application Publication and FIGS. 1-4 hereof, the apparatus includes components configured to project light generated by a plurality of light-emitting members 112 from an inside portion 102 of the apparatus 100 onto an outside surface, through a plurality of apertures 120, according to the present invention. The apparatus 100 may be in the form a child's toy, in particular a toy animal. The toy animal may have an outer shell 130 in which the plurality of apertures 120 are formed. The toy animal may also be plush, as in a "stuffed" animal, with such an outer shell 130 configured at least partially over a body 104 of the toy animal. Similar to FIG. 1 hereof, FIG. 2 hereof is a side view of the apparatus 100 as a "stuffed" toy animal having the outer shell 130 the body 104.

Figure 2:
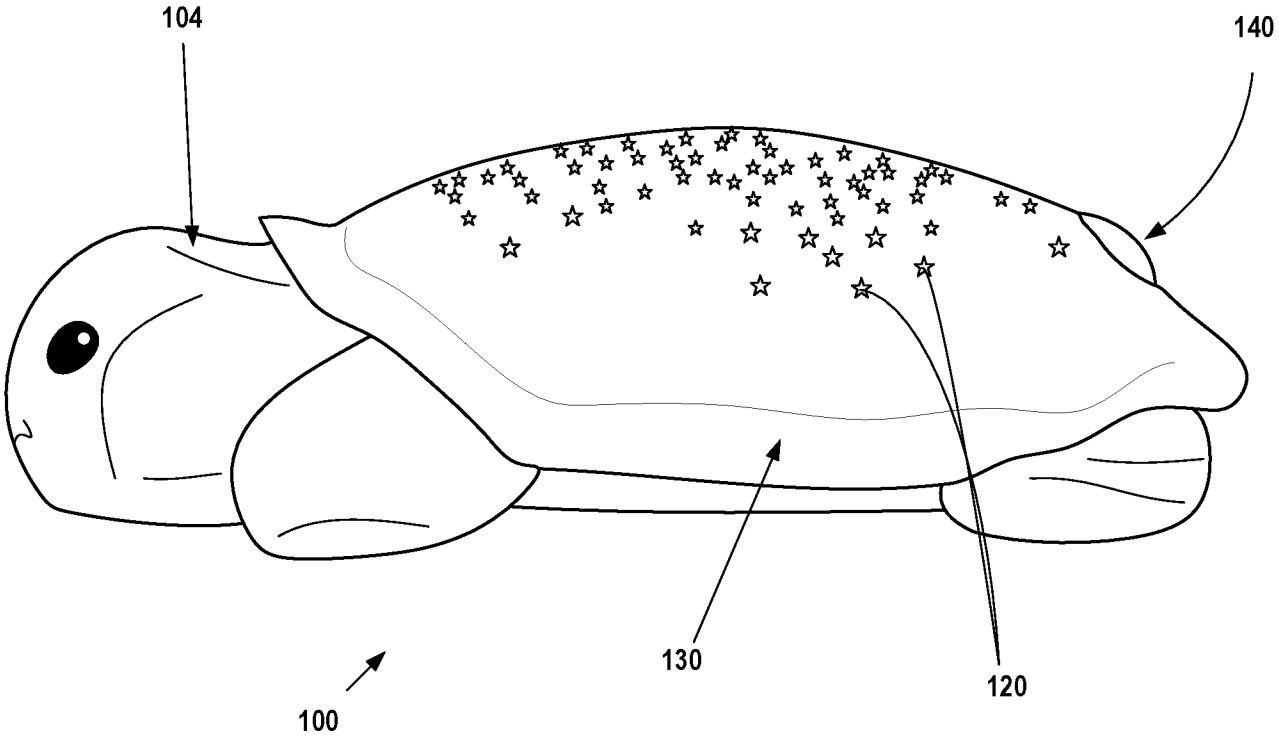
FIG. 2 is a side view of the apparatus and child's toy of FIG. 1.
Figure 4:
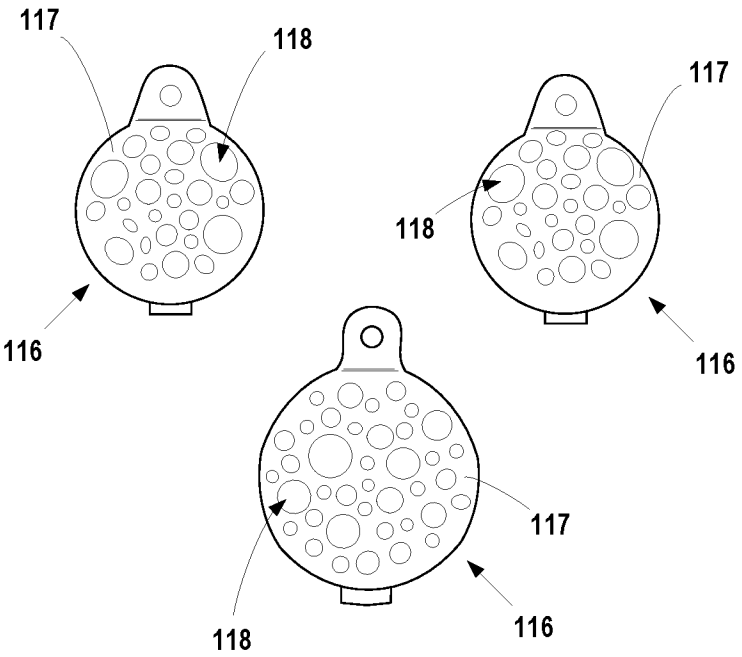
FIG. 4 is a top view of light blockers in internal components of the apparatus and child's toy of FIGS. 1 and 2 showing different configurations of apertures in each light blocker.
Figure 3:
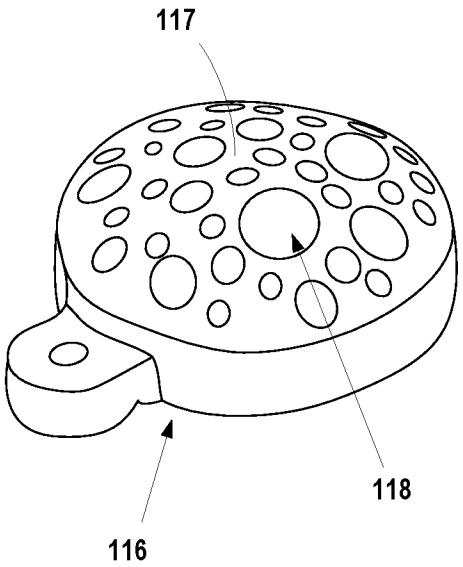
FIG. 3 is a perspective, close-up view of a light blocker in internal components of the apparatus and child's toy of FIGS. 1 and 2.
Figure 6:
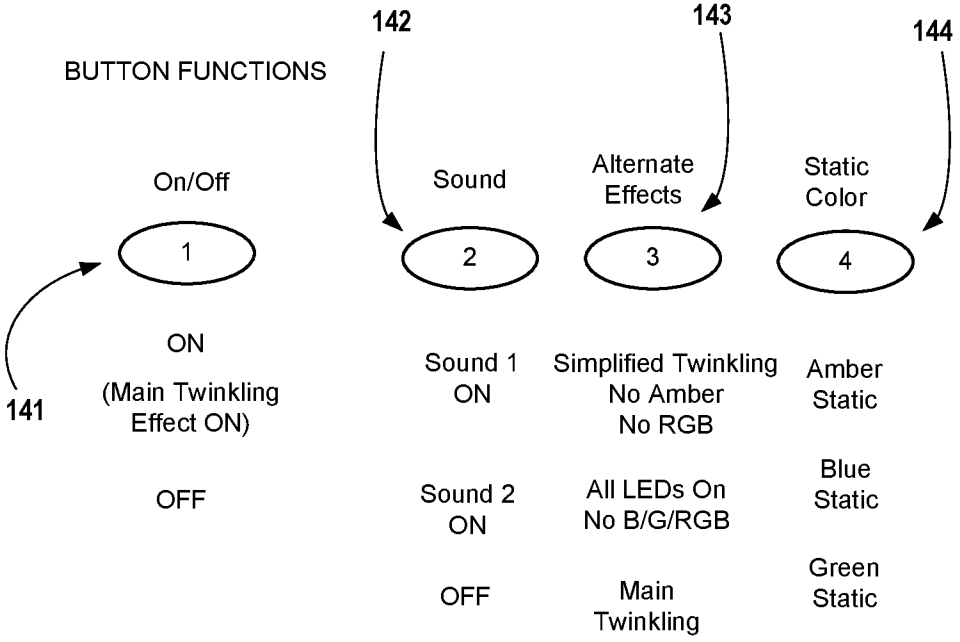
FIG. 6 is a diagram of functions activated by various keys according to another embodiment of the present invention.

Regardless of the configuration of the apparatus 100 as a toy or stuffed animal (or any other such embodiment), as shown in FIG. 3 and FIG. 4 of the Application Publication, the plurality of light-emitting members 112 are part of a plurality of light projection components that are positioned on an inside of the shell 130. The plurality of light-emitting members 112 are coupled to a power source, such as a battery, which may be activated by one or more start or color keys 140 accessible from an outside surface 132 of the shell 130 as indicated in FIG. 1 and FIG. 2 of the Application Publication.

FIG. 3 of the Application Publication is an illustration of one embodiment of the present invention, showing an exemplary configuration of the light projection components and other internal components of the apparatus 100. These include the plurality of light-emitting members 112, which are mounted on an internal surface, substrate or platform 114 at some distance apart from each other to create a different angular representation of the pattern of stars when illuminated. This has the effect of making some stars appear closer, and others more distant, depending on the light-emitting member 112 that has been illuminated. The plurality of light-emitting members 112 may be the same color, different colors, or variations of the same color. Regardless, it is to be understood that the light-emitting members 112 may be any distance from each other, and oriented in any way relative to each other, and this disclosure is not to be limited to any configuration shown or discussed herein. FIG. 4 of the Application Publication is an elevated perspective view of the light projection components and other internal components of FIG. 3 of the Application Publication, and FIG. 5 of the Application Publication is a top view of these light projection components and other internal components, together with the outer shell 130 showing the plurality of apertures 120 therein.

Figure 5:
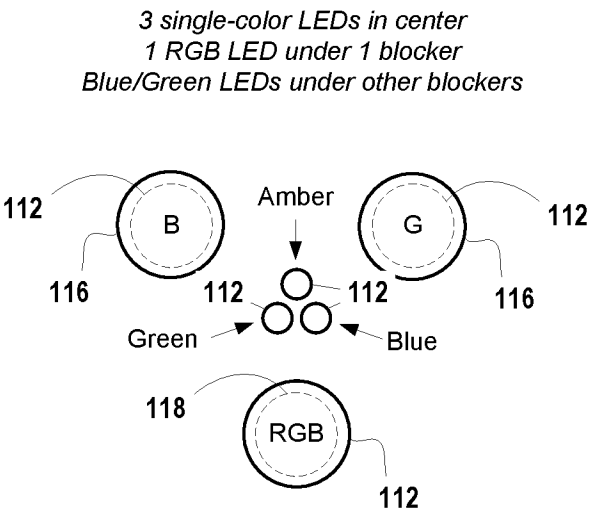
FIG. 5 is a diagram of an exemplary arrangement of light-emitting members according to another embodiment of the present invention.

The light projection components also include a plurality of light blockers 116, each one of which is positioned over a light-emitting member 112 as shown in FIGS. 3, 4 and 5 of the Application Publication. Each light blocker 116 is formed as a casing 117 that acts as a cover for the light-emitting members 112, and includes a plurality of perforations or openings 118 in the casing 117 that together act to allow light through the casing 117 as it is projected towards the plurality of apertures 120 in the outer shell 130 of the apparatus 100. The perforations 118 in each casing 117 may be different in each light blocker, so that the pattern formed by the perforated cover over the light-emitting members 112 is different. Further, as shown more closely in FIG. 6 and FIG. 7 of the Application Publication and in FIGS. 2 and 3 hereof, the perforations or openings 118 may themselves vary in any individual light blocker 116, in that they may be of different sizes, different shapes and having different spacing between perforations. These differences may also vary between the light blockers 116, so that for example each light blocker 116 has a random arrangement of openings 118 with random sizes, shapes, and in-between spacings. Additionally, each casing 117 may be oriented differently over the light-emitting member 112 it covers, relative to the other light blockers 116, to provide additional differentiation in the way light passes to the outer shell 130 from the light-emitting members 112. FIG. 8 of the Application Publication shows a perspective elevated view of a different embodiment of the present invention in which the light blockers 116 have a uniform configuration of openings 118.

Many other configurations and embodiments are possible and contemplated as within the scope of the present invention. For example, light blockers 116 may have any shape, and may be made of any suitable material. The light blockers 116 may be spherical or hemispherical, so as to be fully or partially dome-shaped, or square or rectangular, and may be made of metal, plastic, or other composite material. The casing 117 formed from such material as noted above may be perforated, so that light is blocked by the non-perforated portion thereof. Conversely, light blockers 116 may be a clear plastic dome, with a random blocking pattern printed in black. Different types of light blockers 116 may be used over different LEDs in the same apparatus. Conversely, the light projection components may comprise just a single light blocker 116 covering multiple light-emitting members 112, and having a randomized pattern on the cover so that different portions of different light-emitting members 112 have emitted light blocked when illuminated. In a further embodiment, the light blocker(s) 116 may also rotate on a separate component over the light-emitting members 112 to further randomize the amount of light blocked. Similarly, in another embodiment, the light-emitting members 112 themselves may rotate.

Together, these aspects of the light projection components—spacing at a certain distance apart, both linearly and angularly, together with the placement of the light blockers 116—acts to create different impressions of the patterns formed by the plurality of apertures 120 in the outer shell 130 as light is emitted outward from inside the apparatus 100. In other words, these aspects enable the pattern formed by the apertures 120 to change as different ones of the light-emitting members 112 are illuminated.

This effect is further enhanced by adjusting the illumination of each light-emitting member 112, to create a twinkling effect where only light through certain apertures 120 appears to illuminate and then fade. Each member 112 may therefore be configured to brighten and dim, for example on a predetermined interval. This creates an appearance of some stars fading out occasionally, like one might observe on a slightly cloudy night. Adjustment of illumination, combined with the other aspects of the present invention discussed above, together create a dynamic impression of a night sky on a surface of a room in which the apparatus 100 is placed, with different constellation patterns observed depending on the light-emitting member 112 that is selected. Additionally, the present invention may be configured such that some light-emitting members 112 are always "on" when the apparatus 100 is illuminated, while others may time on and off, or fade in and out, at the same time.

Together, these aspects of the present invention create an effect that makes the stars appear to "twinkle", by making it appear that many of the stars randomly blink on and off individually, as if they are a twinkling night sky on a slightly cloudy night. These aspects of the present invention also prevent duplicity in the projection of light in the form of a constellation of stars through the outer shell 130, to add to the twinkling effect.

The light-emitting members 112 and light blockers 116 may be mounted directly onto a base portion 106 of the apparatus 100, or as noted above, may be placed on a surface, platform or substrate 114 that is elevated at some distance above the base portion 106 and yet still distal from the outer shell 130 covering the base portion 106. The light-emitting members 112 may also be at different heights relative to each other on the surface, platform, or substrate 114, or base portion 106.

It is to be understood that the present invention may include any number of light-emitting members 112, and that they may be singular where positioned, in that only one light-emitting member 112 may be used under a light blocker 116. Alternatively, clusters of light-emitting members 116 may also be positioned under each light blocker 116, and light-emitting members 112 within a cluster may be the same or different colors. It is also to be understand that some light-emitting members 112 may not be positioned under a light blocker 116 at all, or only partially positioned under a light blocker 116. Additionally, light-emitting members 112 may be vertically or angularly oriented relative to the surface, platform or substrate 114 on which they are mounted.

Further, it is to be understood that the light-emitting members 112, regardless of where and how positioned, may be the same color, different shades of the same color, or different colors. Each light-emitting member 112 may be monochromic, or may be multi-colored. The light-emitting members 112 may comprise any source of electroluminescence or source of light, such as for example (but not limited to) light-emitting diodes (LEDs). Additionally, light-emitting members 112 may be blocked by light blockers 116, while others may be unblocked as shown in FIGS. 3, 4 and 5 of the Application Publication.

FIG. 9 is a further illustration of one exemplary arrangement of light-emitting members 112, according to one embodiment of the present invention, where light-emitting members 112 are both blocked and unblocked. In the embodiment of FIG. 9 of the Application Publication and FIG. 5 hereof, under each light blocker 116, a different-colored light-emitting member 112 is positioned. In the center, unaffected by any light blocker 116, additional single-color light-emitting members 112 are positioned. Therefore, the apparatus 100 may include both blocked and unblocked light-emitting members 112 to enhance the effects of the present invention. This provides for a greater number of overall light-emitting members 112, and provides for additional flexibility in the design by allowing the use of multiple light-emitting members 112 under one light blocker 116, but only one light-emitting member under other light blockers 116, as well as some light-emitting members that are not positioned under any light blocker 116.

It is also to be understood that many other embodiments of an apparatus 100 that includes such light projection components are possible, notably in the form of a toy or nightlight that illuminates. Where the light-emitting members 112 are each a different color, the present invention may include a color selection switch having two or more keys thereon for controlling which of the plurality of light-emitting members 112 will be turned on at a given time. The present invention may also include a timer unit operatively coupled to the plurality of light-emitting members 112, where a start key activates the plurality of light-emitting members 112 for a predetermined time sequence.

As noted above, the apparatus 100 may be mounted in a child's toy, in particular a toy animal. The toy animal may also be plush, as in a "stuffed" animal, with such an outer shell 130 configured at least partially over the toy. The body of the apparatus 100 may be formed as any animal. In one embodiment thereof, the apparatus 100 is formed in a shape substantially that of a turtle. Regardless, it is to be understood that the apparatus 100 of the present invention may be incorporated in any device serving as a nightlight for which one intends to project light outward, and need not be in the form or a toy or an animal.

The outer shell 130 may be made of any material, and may be opaque, translucent, cloudy, or have any similar appearance which acts to block light from passing through it except through the plurality of apertures 120. Conversely, the outer shell 130 may be transparent, with no physical operations or perforations, but instead having painted or printed coatings or other portions with "gaps" therein to allow light to pass through. The outer shell 130 may include a plurality of sections, each section having apertures 120 therein which form a pattern such as a constellation, either in a substantially identical specific pattern with other sections when light is outwardly projected through the apertures 120 by the light projection components, or in a different specific pattern from other sections when light is outwardly projected through the apertures 120 by the light projection components.

As noted above, the apparatus 100 includes one or more start or color keys 140 that are accessible from an outside surface 132 of the shell 130 as indicated in FIG. 1 and FIG. 2 of the Application Publication and FIGS. 1 and 2 hereof. These one or more start or color keys 140 may perform many functions, as indicated in FIG. 10 of the Application Publication and FIG. 6 hereof. An on/off key 141 performs an on/off toggle to switch on the main twinkling effect of the present invention, and to switch it off. One of the additional keys 142 may be configured to activate and de-activate sound, and it is to be understood that many sounds may be capable of being played by the apparatus 100, and that the sound key 142 may be used to cycle through different sounds. The present invention may also include a speaker 150 through which sounds emanate. Another of the start and color keys 140 may be configured as an alternate effects key 143, to cycle through different effects emitted by the plurality of light-emitting members 112. Such alternate effects may include a simplified twinkling where one or more of the colors is missing, such as "no amber" or "no RGB", or where all single light-emitting members 112 of FIG. 9 of the Application Publication and FIG. 5 hereof are on but the B G, and RGB light-emitting members 112 are switched off. Further, the key 143 may be used to return to the main twinkling effects function. Still further, a static color key 144 may be included to enable the apparatus to emit only a single, static color, such as amber-only, blue-only, and green-only. The embodiment of FIG. 10 of the Application Publication and FIG. 6 hereof demonstrates that a user has the ability to select only center light-emitting members 112 as indicated in FIG. 9 of the Application Publication and FIG. 5 hereof, to create a "static" projection effect, or to select one of two different "twinkling" patterns, which utilize a combination of unblocked light-emitting members 112 and blocked light-emitting members 112.

The foregoing descriptions of embodiments of the present invention have been presented for the purposes of illustration and description. It is not intended to be exhaustive or to limit the invention to the precise forms disclosed. Accordingly, many alterations, modifications and variations are possible in light of the above teachings, may be made by those having ordinary skill in the art without departing from the spirit and scope of the invention. It is therefore intended that the scope of the invention be limited not by this detailed description. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A projection apparatus comprising: an outer shell mounted on a body that together form a shape of a toy animal, the outer shell having a plurality of apertures that together form a specific pattern in an appearance of a constellation when light is projected through the apertures from inside the outer shell; a plurality of light-emitting members covered by the outer shell and each configured to project light through the apertures; and a plurality of light blockers, said light emitting members spaced at a distance apart from each other to create a different angular representation of the pattern when illuminated, each light blocker comprising a perforated cover that extends over a respective one of the light-emitting members so as to partially block light that is emitted thereby, whereby the emitted light that is not partially blocked is projected through the apertures outwardly onto an exterior surface to create different impressions in the appearance of the constellation formed by the plurality of apertures when light is projected through the apertures.

2. The projection apparatus of claim 1, wherein said light-emitting member is configured to brighten and dim at predetermined intervals independently of another said light-emitting member.

3. The projection apparatus of claim 1, wherein said light-emitting member emits a color of light that is different from a color of light that is emitted by another said light-emitting member.

4. The projection apparatus of claim 1, wherein the body of the projection apparatus is formed in a shape of a toy animal.

5. The projection apparatus of claim 1, wherein the body of the projection apparatus is formed in a shape of a turtle.

6. The projection apparatus of claim 1, wherein each aperture shapes the outwardly-projected light as a celestial body in the appearance of the constellation.

7. The projection apparatus of claim 1, wherein the perforated cover of each light blocker is hemispherical in shape.

8. The projection apparatus of claim 1, wherein each perforated cover of each light blocker has a random arrangement of apertures comprised of different sizes, different shapes, and different spacings between apertures.

* * * * *